US008316965B2

(12) United States Patent
Hallundbaek et al.

(10) Patent No.: US 8,316,965 B2
(45) Date of Patent: Nov. 27, 2012

(54) DRILLING TOOL WITH FLUID CLEANER

(75) Inventors: Jørgen Hallundbaek, Graested (DK); Thomas Sune Andersen, Helsnigør (DK)

(73) Assignee: Welltec A/S, Allerod (DK)

( * ) Notice: Subject to any disclaimer, the term of this patent is extended or adjusted under 35 U.S.C. 154(b) by 80 days.

(21) Appl. No.: 12/528,122

(22) PCT Filed: Feb. 28, 2008

(86) PCT No.: PCT/DK2008/000082

§ 371 (c)(1),
(2), (4) Date: Aug. 21, 2009

(87) PCT Pub. No.: WO2008/104177

PCT Pub. Date: Sep. 4, 2008

(65) Prior Publication Data

US 2010/0018775 A1 Jan. 28, 2010

(30) Foreign Application Priority Data

Feb. 28, 2007 (DK) ..... 2007 00304

(51) Int. Cl.
*E21B 4/02* (2006.01)

(52) U.S. Cl. ..... 175/102; 175/92; 175/314

(58) Field of Classification Search ..... 166/312, 166/311, 99, 162; 175/57, 99, 102, 92, 314, 175/324

See application file for complete search history.

(56) References Cited

U.S. PATENT DOCUMENTS

| | | | | |
|---|---|---|---|---|
| 1,900,029 | A * | 3/1933 | Taylor | 175/99 |
| 2,609,182 | A | 9/1952 | Armais | |
| 3,572,431 | A * | 3/1971 | Hammon | 166/99 |
| 4,137,975 | A * | 2/1979 | Pennock | 175/65 |
| 6,158,512 | A | 12/2000 | Unsgaard | |
| 6,273,189 | B1 * | 8/2001 | Gissler et al. | 166/241.1 |
| 2006/0213693 | A1 | 9/2006 | Zahradnik et al. | |

FOREIGN PATENT DOCUMENTS

| | | |
|---|---|---|
| DE | 523514 | 4/1931 |
| DE | 2807917 | 9/1978 |
| DE | 2808206 | 9/1978 |
| WO | WO 2004/011766 | 2/2004 |
| WO | WO 2005/033471 | 4/2005 |

OTHER PUBLICATIONS

Danish Search Report dated Oct. 12, 2007.

* cited by examiner

*Primary Examiner* — Nicole Coy
*Assistant Examiner* — Richard Alker
(74) *Attorney, Agent, or Firm* — Cozen O'Connor

(57) ABSTRACT

Drilling tool (1) for drilling a well downhole where fluid is surrounding the tool and where the tool has a housing (15) and is connected to an electrical conducting means, such as a wireline. The drilling tool has a drilling head (2) and a fluid cleaner (3) for removal of elements, such as debris and formation pieces, from the fluid while drilling downhole. The fluid cleaner has a chamber (4) and a filter (5) within the chamber for separation of the elements from the fluid. The tool further comprises a pump (8) for pumping the fluid into the chamber through an inlet (11) in the drilling head (2) and through the filter before entering the well again. Furthermore, the tool comprises a driving unit for driving the pump and the drilling head.

9 Claims, 7 Drawing Sheets

DRILLING TOOL WITH FLUID CLEANER

PRIORITY CLAIM

This is a U.S. national stage of application No. PCT/DK08/000082, filed on Feb. 28, 2008. Priority is claimed on the following application: Country: Denmark, Application No.: PA 2007 00304, Filed: Feb. 28, 2007, the content of which is incorporated here by reference.

TECHNICAL FIELD

The present invention relates to a drilling tool for drilling a well downhole where fluid is surrounding the tool and where the tool is connected to an electrical conducting means, such as a wireline.

BACKGROUND ART

Drilling tools are used when drilling a well downhole. Drilling may also be performed in an existing well for making a branch well. While drilling a borehole into the subterranean formation, the fluid surrounding the drilling tool is filled with elements such as debris and formation pieces released from the formation. If the debris and formation pieces are not pumped up, they will interfere with and aggravate the drilling process.

The fluid containing debris and formation pieces is typically pumped up to above surface, after which the debris and formation pieces are filtrated from the fluid. Such processes are very energy consuming since the fluid has to be pumped all the way up to above surface only to be poured into the well again.

An attempt to filtrate debris and formation pieces from the fluid downhole while drilling is disclosed in DE 28 08 206, in which the drilling tool ejects the filtrated fluid out through the drilling head and has an intake of fluid in the part of the tool closest to the wireline. In this way, the fluid containing debris and formation pieces is forced along the side of the tool, resulting in that the debris and formation pieces are squeezed between the formation and the tool whereby the tool is at risk of getting stuck.

Furthermore, the debris and formation pieces forced along the side of the tool are pumped to above the tool. Thus, the debris and formation pieces fill the space above the tool and may obstruct the return path of the tool to above surface. This problem is particularly relevant in regard to wireline tools, which have a limited amount of power in relation to tools using coiled tubing drilling.

DESCRIPTION OF INVENTION

An aspect of the present invention is, at least partly, to overcome the disadvantages of the tools mentioned above, and to provide an improved drilling tool which is simple in its construction.

This aspect and the advantages becoming evident from the description below are obtained by a drilling tool for drilling a well downhole where fluid is surrounding the tool and where the tool has a housing and is connected to an electrical conducting means, such as a wireline, comprising:

a drilling head, a pump for pumping the fluid through an inlet in the tool, a driving unit for driving the pump and the drilling head, a fluid cleaner for removal of elements, such as debris and formation pieces, from the fluid while drilling downhole, wherein the fluid cleaner has a chamber, and a filter within the chamber for separation of the elements from the fluid, wherein the pump pumps the fluid into the chamber through the inlet and through the filter and out through an outlet in the housing of the tool, and wherein the inlet is positioned in the drilling head.

In one embodiment, the drilling head may have at least two drilling arms for providing a rotational drilling process.

In another embodiment, the drilling head may have a plurality of drill bits.

Furthermore, the pump may be a centrifugal pump, a jet pump, or a piston pump.

In addition, the chamber may have a chamber inlet adjacent to the drilling head, and this chamber inlet may have at least one one-way valve arranged so as to open to let fluid into the chamber and close to prevent the same fluid from flowing through the inlet out of the chamber.

In another embodiment, the one-way valve of the tool may have at least one flap which opens to let fluid into the chamber and closes to prevent the same fluid from flowing through the inlet out of the chamber.

In yet another embodiment, the filter may be an elongated filter extending in the chamber having a length L and wherein the filter has a length that is at least one fourth of the length of the chamber L.

In addition, the filter may have the same length as the chamber so that the filter extends all the way through the chamber.

Furthermore, the invention relates to a drilling system for removing elements, such as debris and formation pieces, from fluid while drilling downhole, comprising a drilling tool as described above, and a driving unit such as a downhole tractor for moving the fluid cleaner in the well.

Finally, the invention also relates to a drilling process for drilling e.g. a well in a formation or the like downhole, comprising the steps of:

introducing a drilling tool as described above, drilling into the formation and releasing elements of the formation, sucking fluid containing the elements in through at least one inlet 11 in the drilling head, filtrating the elements from the fluid, pumping the filtrated fluid back into the well through at least one outlet 6 in the tool in the end of the tool closest to the wireline, and sucking the filtrated fluid through a gap between the tool and the inside formation wall of the well.

BRIEF DESCRIPTION OF THE DRAWINGS

The invention is explained in detail below with reference to the drawings, in which.

The drawings are merely schematic and shown for an illustrative purpose.

DETAILED DESCRIPTION OF THE INVENTION

Figure 1:
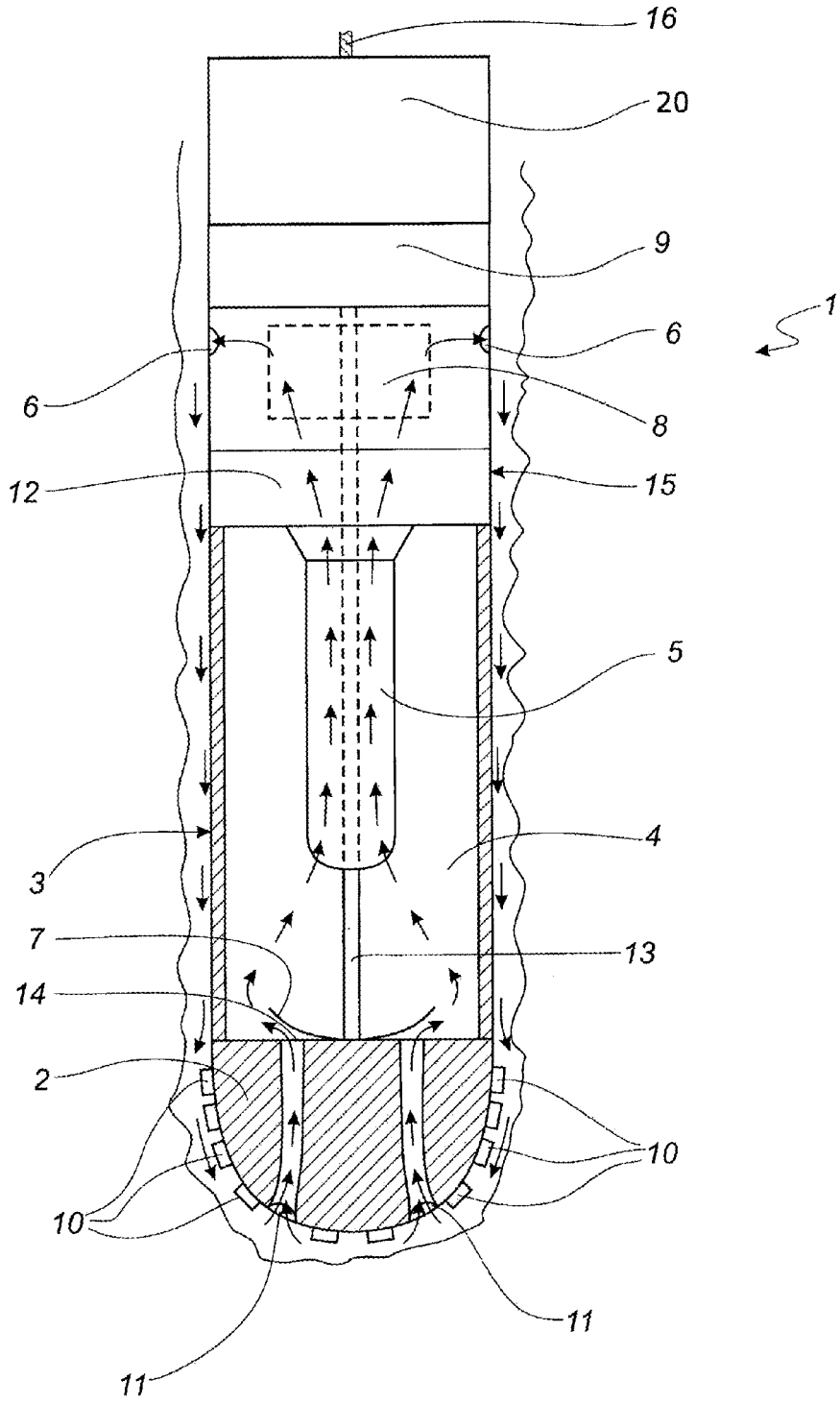
FIG. 1 shows a drilling tool according to the invention.
Figure 2:
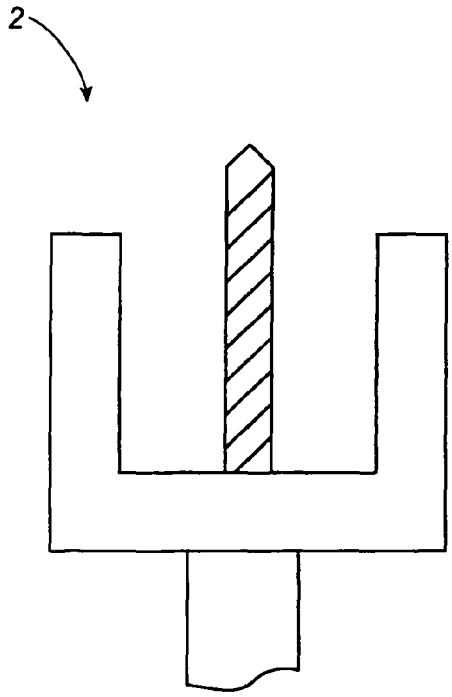
FIG. 2 shows a drilling head.
Figure 3:
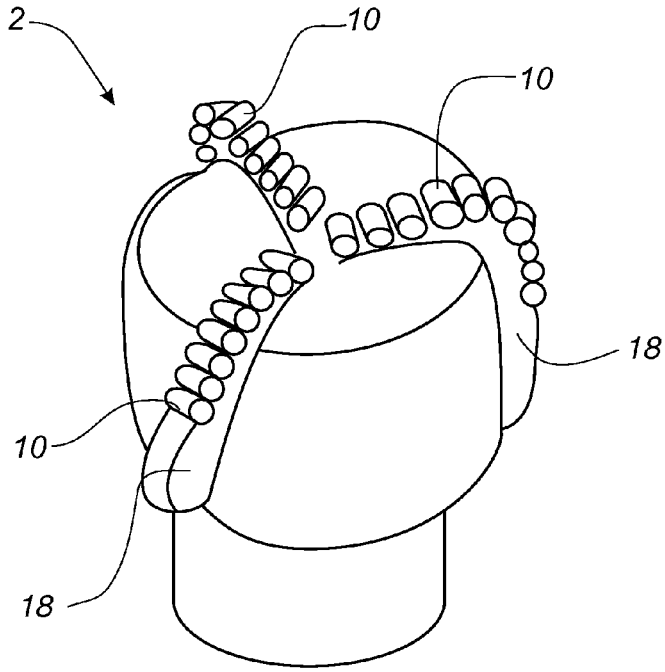
FIG. 3 shows another embodiment of the drilling head.
Figure 4:
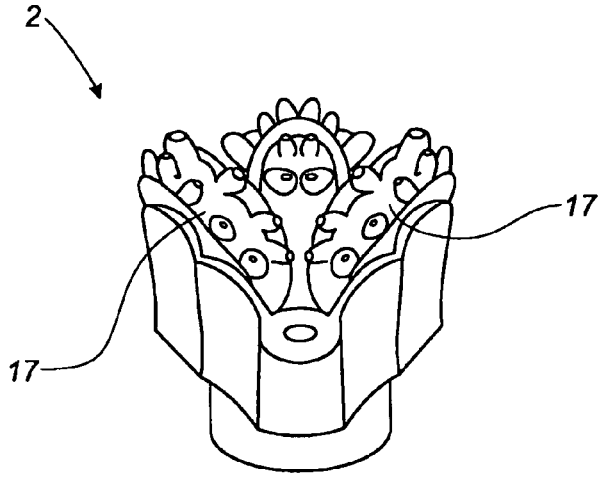
FIG. 4 shows yet another embodiment of the drilling head.
Figure 5:
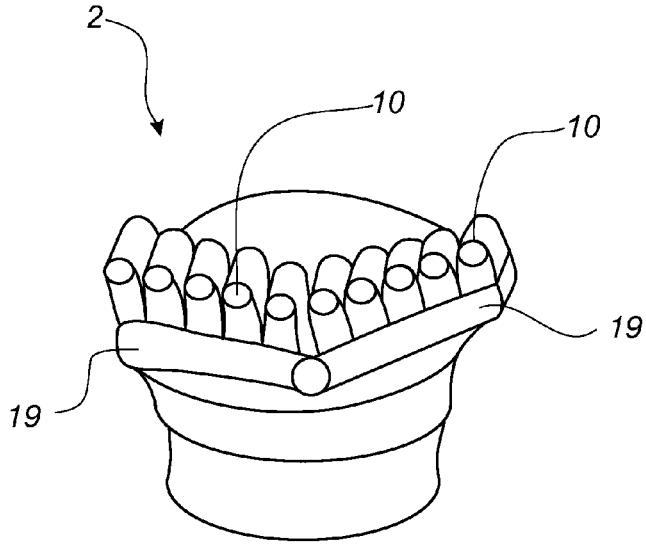
FIG. 5 shows an additional embodiment of the drilling head.

In FIG. 1, a drilling tool 1 according to the invention is shown while drilling in a formation downhole. The drilling tool 1 has a drilling head 2 with several drill bits 10 and two inlets 11 for suction of fluid. Furthermore, the drilling tool has a fluid cleaner 3 positioned so as to clean or filtrate the fluid before the fluid is ejected through the outlets 6 in a housing 15. The fluid cleaner 3 comprises a chamber 4 into which fluid flows. In the drawings, the flow of the fluid is illustrated by arrows.

Inside the chamber 4, a filter 5 for filtrating the elements from the fluid is situated so as to allow the fluid to flow through the filter 5 while the elements are sifted out by the filter 5. The separated elements are mostly debris and formation pieces, but may be any kinds of sand, pipe dope, remains from a previous explosion, rust from the casing in the well, or detachments torn off from the well, the casing, or the formation.

In one end, the tool 1 is connected to a wireline 16 which again is connected to a power supply situated on e.g. an oil rig above surface (not shown). In the other end of the tool, the drilling head 2 is situated. In FIG. 1 the drilling head is shown having two inlets 11; however, the number of inlets may vary. Since the inlets are situated in the front of the tool in the drilling head, the fluid is led past the drill bits 10 of the drilling head, whereby the bits 10 are flushed during the drilling operation.

In FIG. 1, the inlets 11 are shown as being substantially in the front of the tool, namely in the front of the drilling head 2; however, in another embodiment, the inlets may be situated along the whole extension of the drilling head so that inlets are situated both in front of the drilling head 2 and further away from the centre of the drilling head, depending on the design of the drilling head.

The fluid surrounding the tool is sucked in through the inlets 11 in the drilling head 2 and, in this way, the fluid between the formation and the tool is sucked downwards into these inlets 11. Therefore, elements released by the drilling operation and accumulated in the surrounding fluid are no longer at risk of getting stuck between the tool and the formation, since the fluid is forced in the same direction as the tool, i.e. in the drilling direction, in through the drilling head 2.

Prior art drilling tools enabling fluid filtration downhole force the fluid containing released elements in the opposite direction of the drilling direction by sucking the fluid in through inlets in the end of the tool furthest away from the drilling head of the tool and ejecting the filtrated fluid through the drilling head. In this way, the elements released from the drilling process are squeezed in between the outside wall of the tool and the formation during the drilling operation, since the tool moves in one direction and the fluid containing released elements moves in the opposite direction. In this way, the prior art tools are at risk of getting stuck while drilling.

The chamber 4 has at least one outlet 6 through which filtrated fluid passes. Once again, drilling pieces then accumulate in the filtrated fluid before the fluid enters the inlets 11 in the drilling head 2. In this way, the fluid having to pass between the tool and the inside formation wall of the well is substantially filtrated, thus diminishing the risk of the tool getting stuck.

The smallest gab between the tool and the inside wall of the formation is that between the side of the drilling head perpendicular to the drilling direction and the inside wall of the formation. At least in some embodiments, the part of the tool behind the drilling head may have a smaller outside diameter than that of the drilling head.

In one embodiment, a chamber inlet 14 of the chamber 4 is provided with a one-way valve 7 opening to let fluid into the chamber 4 and closing to prevent the same fluid from flowing through the chamber inlet 14 out of the chamber 4 and out through the drilling head. In another embodiment, the one-way valve 7 is in the form of a flap which is arranged so as to open for letting fluid into the chamber 4 and close for preventing the same fluid from flowing through the chamber inlet 14 out of the chamber 4. The flap may be in the form of a ring around the filter. The ring may be divided into a plurality of flaps corresponding to the number of chamber inlets 14. The ring is a flexible ring made from e.g. a thin metal sheet, rubber, polymer, silicone, or the like material.

In yet another embodiment, the one-way valve may be in the form of a ball check valve, a diaphragm check valve, a swing check valve, a clapper valve, a stop-check valve, or another kind of one-way valve.

The filter 5 is designed as an elongated member and arranged to extend along the centre axis of the chamber 4. The debris and formation pieces which have been separated from the fluid by the filter 5 are then collected by the chamber 4 and placed in the cavity between the filter 5 and the inside of the chamber 4. The fluid which has passed the filter 5 is let out through outlets 6 so that the fluid, when passing the filter 5, re-enters the well again.

Furthermore, the tool comprises a pump 8 driven by a driving unit 9. In this way, the fluid is sucked into the inlet 11 of the drilling head 2 and further into the chamber inlets 14, through the filter 5 and past a gear connection 12 into the pump and out through outlets in the housing 15 of the tool 1. In this embodiment, the driving unit 9 is an electrical motor which drives both the pump 8 and the drilling head 2. The motor has a shaft 13 which penetrates the filter 5 and drives both the pump 8 and the drilling head 2. The shaft 13 is connected to the drilling head 2 through a gear connection 12.

Figure 8:
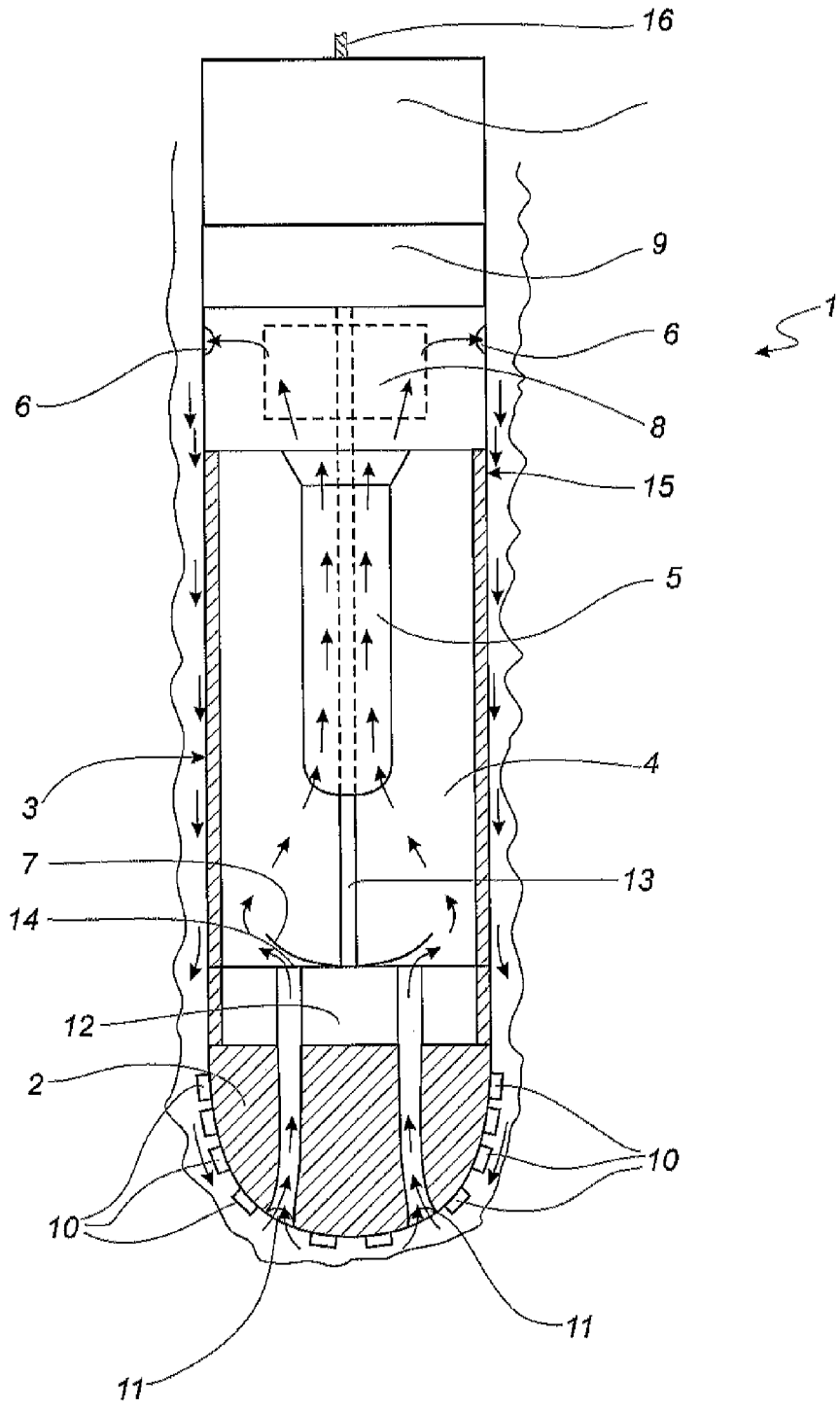
FIG. 8 shows another drilling tool according to an embodiment of the invention.

The gear connection is shown in FIG. 1 as being positioned between the chamber and the pump; however, in another embodiment, as shown in FIG. 8, the gear connection may be positioned between the chamber and the drilling head. In this way, one drilling head 2 may be replaced by another drilling head 2.

The drilling tool 1 may have all kinds of known drilling heads 2, such as the ones shown in FIGS. 2-5. Instead of a drilling head 2 with e.g. three rotating wheels 17 or drill bits in rows 18, the drilling tool 1 may also have two rotating arms 19 having a plurality of bits 10. The particular drilling head 2 is chosen in accordance with the type of drilling operation. The drilling head 2 shown in FIG. 1 has a plurality of drill bits 10 in order to cut into the formation and release pieces thereof.

The pump 8 may be any kind of suitable pump. In this embodiment, the pump 8 is a one-step centrifugal pump, but in another embodiment the pump 8 may be a multi-step centrifugal pump, a jet pump, or a piston pump.

In one embodiment, the chamber 4 has a length L which corresponds to the longitudinal extension of the chamber 4. In another embodiment, the extension length of the filter 5 is ¼ of the length L of the chamber 4. In yet another embodiment, the extension length of the filter 5 is ½ or ⅔ of the length L of the chamber 4. In yet another embodiment, the filter has the same length as the chamber.

The chamber 4 is shown as ending at the pump section so that the chamber 4 does not comprise the pump section. In this way, the pump section may have a larger extension in the direction perpendicular to the extension axis of the tool. However, in another embodiment, the chamber 4 extends past and encloses the section comprising the pump 8.

Figure 6:
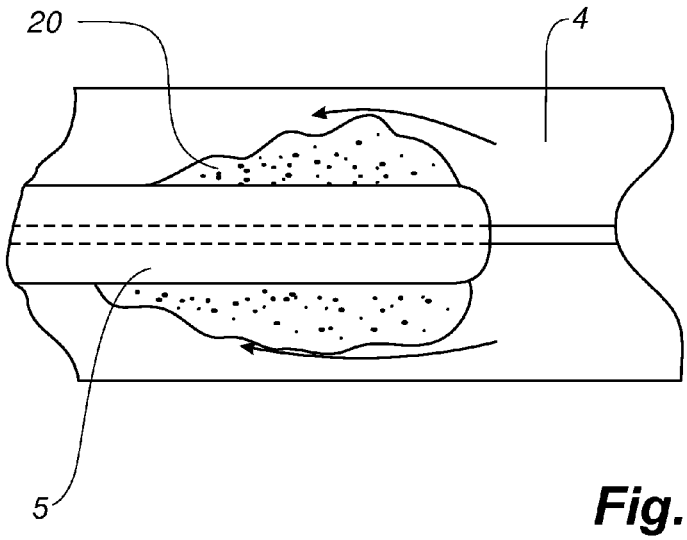
FIG. 6 shows a sectional view of the drilling tool of FIG. 1.
Figure 7:
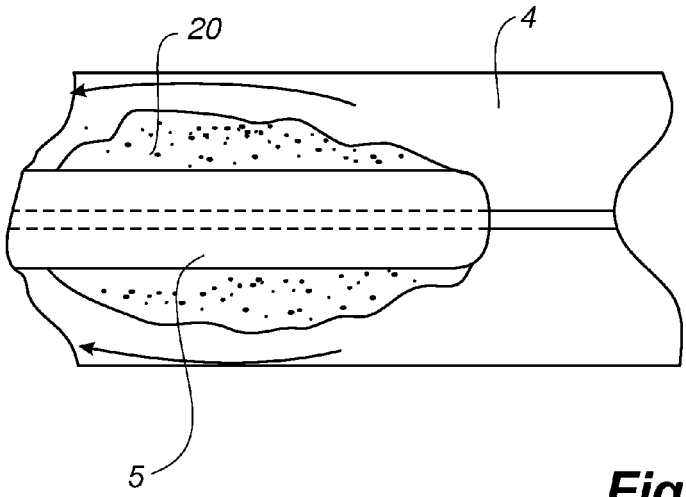
FIG. 7 shows the same sectional view as FIG. 6.

When elements, such as debris and formation pieces, have been separated from the fluid, the elements will initially be deposited in a pile 20 as shown in FIG. 6. However, the fluid will flow around the pile 20 of elements and thus move the pile towards the pump 8 as shown in FIG. 7, and the pile 20 will move accordingly. In this way, almost the entire capacity of the chamber 4 is used, filling the chamber 4 perfectly with debris or other elements while the front of the filter 5 is kept free of elements. Therefore, the elements will not block the filter 5 before the chamber 4 is almost filled and must be emptied anyway.

In the event that the drilling tool 1 is not submergible all the way into the casing, a downhole tractor 20 can be used to draw or push the pump system all the way into position in the well. A downhole tractor 20 is any kind of driving tool able to push or pull tools in a well downhole, such as a Well Tractor®.

For illustrative purposes, the fluid is described as a fluid containing pieces of formation and debris before entering the filter 5. However the fluid may also contain other elements such as cuttings, swarf, sand, pipe dope, remains from a previous explosion, rust from the casing in the well, or detachments torn-off from the well, the casing, or the formation. Within the scope of the invention, the fluid may be any kind of downhole fluid such as oil, water, a mix of oil with water, gas, or the like. In many drilling operations, the fluid is mixed with filtrate in order to improve the drilling process.

The invention claimed is:

1. A wireline drilling tool for drilling a well downhole where fluid is surrounding the tool and where the tool has a housing and is connected to an electrical conducting means, comprising:

a drilling head, a pump for pumping the fluid in through an inlet in the tool, a driving unit for driving the pump and the drilling head, and a fluid cleaner for removal of elements from the fluid while drilling downhole, wherein the fluid cleaner has a chamber, and a filter within the chamber for separation of the elements from the fluid, wherein the pump pumps the fluid, in the following order, into the chamber through the inlet and a chamber inlet and through the filter past a gear connection into the pump and out through an outlet in the housing of the tool, and wherein the inlet is positioned in the drilling head.

2. The wireline drilling tool according to claim 1, wherein the drilling head has at least two drilling arms for providing a rotational drilling process.

3. The wireline drilling tool according to claim 1, wherein the drilling head has a plurality of drill bits.

4. The wireline drilling tool according to claim 1, wherein the pump is a centrifugal pump, a jet pump, or a piston pump.

5. The wireline drilling tool according to claim 1, wherein the chamber inlet is adjacent to the drilling head, and wherein the chamber inlet has at least one one-way valve arranged so as to open to let the fluid into the chamber and close to prevent the fluid from flowing through the chamber inlet out of the chamber.

6. The wireline drilling tool according to claim 5, wherein the one-way valve has at least one flap which opens to let the fluid into the chamber and closes to prevent the fluid from flowing through the inlet out of the chamber.

7. The wireline drilling tool according to claim 1, wherein the filter is an elongated filter extending in the chamber having a length L and wherein the filter has a length that is at least one fourth of the length of the chamber L.

8. A wireline drilling system for removing elements from fluid while drilling downhole, comprising:

the wireline drilling tool according to claim 1, and a downhole tractor for moving the wireline drilling tool in the well.

9. A wireline drilling tool for drilling a well downhole where fluid is surrounding the tool and where the tool has a housing and is connected to an electrical conducting means, comprising:

a drilling head, a pump for pumping the fluid in through an inlet in the tool, a driving unit for driving the pump and the drilling head, and a fluid cleaner for removal of elements from the fluid while drilling downhole, wherein the fluid cleaner has a chamber, and a filter within the chamber for separation of the elements from the fluid, wherein a gear connection is positioned between the chamber and the drilling head, wherein the pump pumps the fluid into the chamber through the inlet, past the gear connection, in through the chamber inlet and through the filter into the pump and out through an outlet in the housing of the tool, and wherein the inlet is positioned in the drilling head.

* * * * *